US005462633A

United States Patent [19]

Manusch et al.

[11] Patent Number: 5,462,633

[45] Date of Patent: Oct. 31, 1995

[54] APPLICATOR-ROLLER ASSEMBLY FOR TAPE DISPENSER

[75] Inventors: Cristoph Manusch, Hemmingen; Udo Obersteller, Langenhagen, both of Germany; Willem Klaassen, Drunen, Netherlands

[73] Assignee: Pritt Produktionsgesellschaft mbH, Hanover, Germany

[21] Appl. No.: 268,287

[22] Filed: Jun. 29, 1994

Related U.S. Application Data

[63] Continuation of Ser. No. 984,943, Dec. 3, 1992, abandoned.

[30] Foreign Application Priority Data

Dec. 3, 1991 [DE] Germany ..... 41 39 808.4

[51] Int. Cl.[6] ..... B32B 31/00

[52] U.S. Cl. ..... 156/577; 156/523; 156/574; 156/579

[58] Field of Search ..... 156/391, 493, 156/523, 527, 554, 555, 577, 579

[56] References Cited

U.S. PATENT DOCUMENTS

| | | | |
|---|---|---|---|
| 3,098,782 | 7/1963 | Powers | 156/527 X |
| 3,641,643 | 2/1972 | Niemi | 156/579 |
| 3,785,901 | 1/1974 | Fritzinger | 156/527 |
| 3,787,271 | 1/1974 | Wahlquist | 156/579 X |
| 3,813,274 | 5/1974 | Rothenberger | 156/527 |
| 3,969,181 | 7/1976 | Seabold | 156/577 |
| 4,648,935 | 3/1987 | Brown et al. | 156/579 X |
| 4,718,971 | 1/1988 | Summers | 156/540 |
| 4,869,774 | 9/1989 | Wisbey | 156/523 |
| 5,296,084 | 3/1994 | Hattori et al. | 156/554 |

FOREIGN PATENT DOCUMENTS

| | | |
|---|---|---|
| 0092187 | 10/1983 | European Pat. Off. . |
| 2061281 | 6/1971 | France . |
| 2801540 | 7/1979 | Germany . |
| 3109735 | 2/1982 | Germany . |
| 35-10699 | 5/1960 | Japan . |
| 40-20436 | 9/1965 | Japan . |
| 52-14438 | 4/1977 | Japan . |
| 56-36663 | 4/1981 | Japan . |

OTHER PUBLICATIONS

Kessler & Luch GmbH, Gebrauchsmuster, G 88 16 290.7, Jul. 1989.

*Primary Examiner*—James J. Engel
*Attorney, Agent, or Firm*—Herbert Dubno; Andrew Wilford

[57] ABSTRACT

A dispenser for a tape having a sticky side has a housing adapted to hold a supply of the tape and a roller rotatable on the housing about an axis and having a mainly cylindrical outer surface projecting radially past the housing. The tape passes partially around the roller with its sticky side turned radially away from the roller and engaging a central portion of the roller surface so that the tape can be pressed by the roller against a substrate to adhere the tape to the substrate and to inwardly deflect the central portion of the roller surface. Elements axially flanking the roller permit deflection of the roller surface in contact with the tape inward until the elements contact the surface and prevent further inward deflection of the central portion of the roller surface even if the elements are pressed with greater force against the substrate.

13 Claims, 3 Drawing Sheets

APPLICATOR-ROLLER ASSEMBLY FOR TAPE DISPENSER

Cross Reference to Related Applications

This application is a file-wrapper-continuation of application Ser. No. 07/984,983 filed 3 Dec. 1992, abandoned, with a claim to the priority of German application P 41 39 808.4 itself filed 3 Dec. 1991.

FIELD OF THE INVENTION

The present invention relates to a tape dispenser or applicator. More particularly this invention concerns an applicator-roller assembly for such a dispenser.

BACKGROUND OF THE INVENTION

A standard tape dispenser/applicator has a housing containing a roll of tape having a sticky side coated with a contact adhesive. In a standard arrangement such as described in European patent document 92,187, German 3,109,735, German 2,801,540, and U.S. Pat. No. 3,813,274 the tape passes sticky side out under an applicator roller that is rotatably mounted on an edge of the housing so that this roller can press the tape down against a substrate the tape is to be applied to. Thus the user presses the applicator roller down to adhere the end of the tape to the substrate, then pulls the housing along the substrate to pay out the tape while simultaneously pressing it to the substrate, and lifts it at the end of the desired path, normally thereby actuating an automatic cutter in the device or bringing a blade into engagement across the tape to cut off the piece stuck to the substrate.

The applicator roller itself is normally a cylindrical body which can be formed at least partially of compressible material as described in U.S. Pat. No. 3,969,181 and French 2,061,281. The roller may also have a hard core.

A problem with this arrangement is that the pressure that is applied to the applicator roller and thence to the tape is wholly determined by how hard the user presses on the device. When the substrate is relatively fragile, for instance tracing paper, the result can be tearing of this substrate or formation of wavy bumps on it due to the occasionally excessive application pressure.

OBJECTS OF THE INVENTION

It is therefore an object of the present invention to provide an improved applicator-roller assembly for a tape dispenser.

Another object is the provision of such an improved applicator-roller assembly for a tape dispenser which overcomes the above-given disadvantages, that is which prevents the tape from being pushed with too much force against the substrate even if the user is bearing very heavily on the dispenser.

A further object is to provide such a dispenser which can apply tape smoothly even to a relatively light substrate sheet, for instance paper weighing no more than 30g/m$^2$.

SUMMARY OF THE INVENTION

A dispenser for a tape having a sticky side has according to the invention a housing adapted to hold a supply of the tape and a roller rotatable on the housing about an axis and having a mainly cylindrical outer surface projecting radially past the housing. The tape is guided partially around the roller with its sticky side turned radially away from the roller and with the tape engaging a central portion of the roller surface so that the tape can be pressed by the roller against a substrate to adhere the tape to the substrate and inwardly deflect the central portion of the roller surface. Elements axially flanking the roller permit deflection of the roller surface in contact with the tape inward until the elements contact the surface and prevent further inward deflection of the central portion of the roller surface even if the elements are pressed with greater force against the substrate, since these elements themselves cannot be inwardly deflected.

Thus with this arrangement as the roller and tape are pressed down onto the substrate, the tape is pressed upward into or with the roller until a certain maximum pressure is reached and the elements engage the substrate. Thereafter as downward pressure increases, the elements merely bear with increased force on the substrate, but the tape itself is still pressed with the same previously limited maximum force.

The invention is based on the discovery that the user of such a dispenser typically exerts on it much more force than is actually necessary to stick the tape to the substrate. Thus the tape is compressed and is adhered in compressed form, so that when the pressure is released the tape puckers and forms surface irregularities. The instant invention therefore limits the pressure actually applied to the tape to a certain relatively low upper limit, ensuring good adherence without deforming the tape.

According to a feature of this invention the elements are formed on the roller as end flanges. The flanges can be unitarily formed with the central portion of the roller but can extend radially somewhat past it so that once the tape is compressed to a thickness equal to the difference between the diameters of the roller central portion and end flanges, further compression is impossible. These end flanges can be axially extended, that is can project axially oppositely from the roller to provide a greater bearing surface and thereby prevent the higher force from deforming the substrate. In this case the roller and its flanges are formed of the same hard material, a hard plastic, a metal, or even a glass or ceramic. Alternately the roller has a central elastomeric covering that is relatively thick in a central region and has thin end regions that extend axially over the flanges so that as application pressure increases, resistance increases smoothly until the end regions can no longer be compressed. Otherwise the roller can be provided in the center with an elastomeric covering with the flanges projecting radially between 0.05 mm and 0.1 mm past the covering. In another arrangement the roller is of uniform cylindrical shape with a softer central region formed by an elastomeric covering or tube having a Shore A hardness between 15 and 40, preferably 20.

According to a further feature of this invention the material of the roller has a Shore A hardness of between 20 and 50 and the elements are formed as rotatable or even nonrotatable support skids that are mounted on the housing. A spring braced between the roller and the housing biases the roller outward out of the housing past the elements. In this case the elements are formed of a metal or a hard synthetic resin, preferably acrylonitrile-butadiene-styrene or polystyrene.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
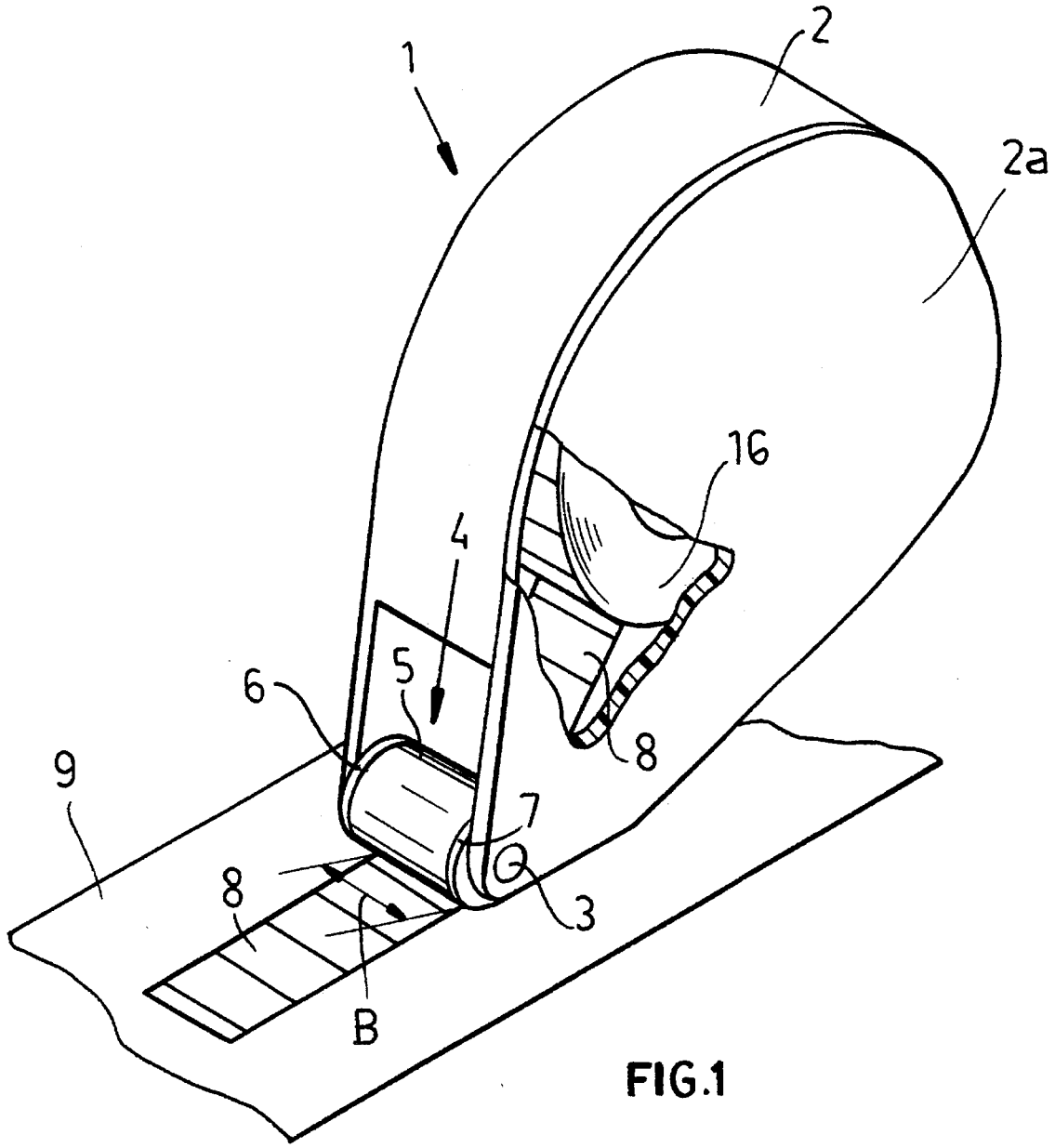
FIG. 1 is a partly broken-away perspective view of the dispenser according to the invention.
Figure 2:
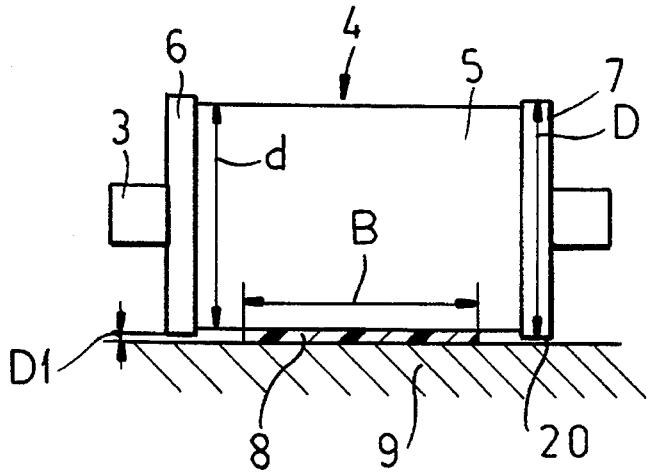
FIG. 2 is a side view of the roller of the dispenser of FIG. 1.

As seen in FIGS. 1 and 2 a tape dispenser 1 has a housing 2 in which is supported a pivot shaft 3 on which is rotatable an applicator roller 4. Inside the housing 2, whose one wall 2*a* is removable, is a spool supply 16 of a tape 8 which is drawn, sticky side out, over the roller 4 for application to a substrate 9, here formed by a sheet of paper. Thus the housing 2 acts as guide means for passing the tape 8, sticky side out, over the roller 4.

In this embodiment the roller 4 has a pair of identical cylindrical end flanges 6 and 7 having cylindrical outer surfaces 20 and a cylindrical center portion 5. The end flanges 6 and 7, the pins forming the shaft 3, and the center portion 5 are all formed of the same hard material, e.g. metal or a hard synthetic resin, and are coaxial, and the diameter d of the center portion 5 is slightly less than the diameter D of the end flanges. The difference is equal to slightly less than the thickness of the tape 8 so that if the center portion 5 is just touching this tape 8 the flange surfaces 20 will clear the planar substrate 9 by a distance D1 equal to somewhat less than the tape thickness.

The tape 8 has a width B which is substantially less than the axial spacing between the end flanges 6 and 7 so that if the roller 4 is pressed down on the tape 8 it will compress it somewhat. The amount of compression is, however, limited since once the flange surfaces 20 contact the substrate 9, compression of the tape 8 will stop. Thus no matter how hard the user presses down, the tape 8 will not be excessively compressed to form wavy bumps as it is payed out.

Figure 3:
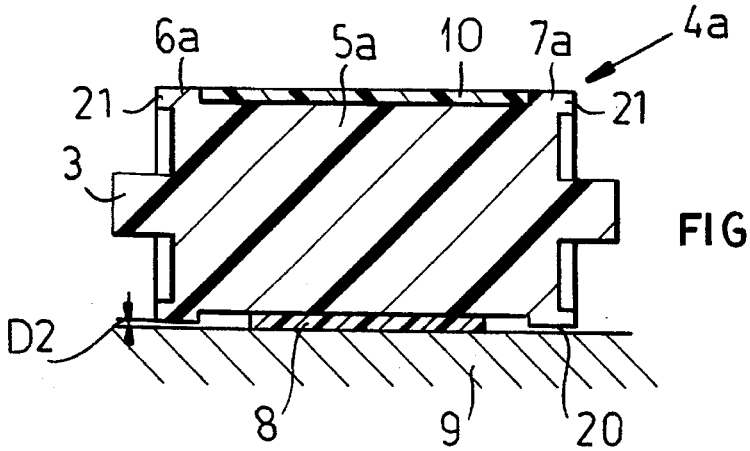
FIGS. 3, 4, and 5 are views like FIG. 2 of further rollers according to the invention.

In the arrangement of FIG. 3 an applicator roller 4*a* is provided in its central region 5*a* with a thin annular strip 10 of softer material, here a highly elastically compressible synthetic resin set in a groove whose outer surface has the diameter d. The outer surfaces at the end flanges 6*a* and 7*a*, which are extended axially outwardly at 21, and the outer surface of the central portion 5*a* are of the same diameter. The soft layer 10, however, allows the tape to be pressed inward by a distance D2 larger than the distance D1 since it is accounted for both by compression of the tubular strip 10 and by the tape 8.

Figure 4:
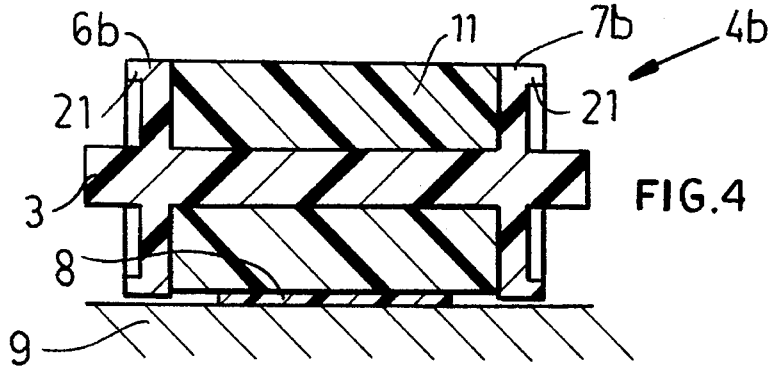

FIG. 4 shows a roller 4*b* having extended flanges 6*b* and 7*b* like FIG. 3, but a central portion formed by a thick body 11 of the same diameter D as the end portions 6*b* and 7*b*. The body 11 is formed, however, of a synthetic resin that is much softer than the resin forming the two flanges 6*b* and 7*b* and the integral shaft 3 joining them and traversing the body 11.

Figure 5:
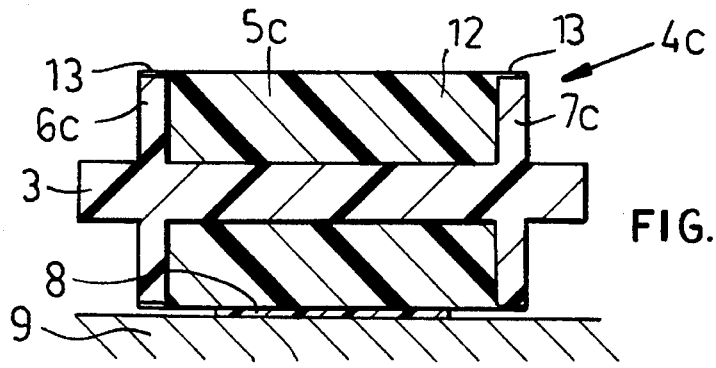

The arrangement of FIG. 5 is substantially identical to that of FIG. 4. Here, however, a softer center body 12 has end ridges 13 that extend axially over the flanges 6*c* and 7*c*. Thus the entire outer surface of the roller 4*c* is formed by the softer material, but its middle region 5*c* is radially much more compressible than the end regions at the flanges 6*c* and 7*c*. With this arrangement the roller provides a smooth and continuous outer surface, but the outer ends are substantially less compressible than the center.

Figure 6:
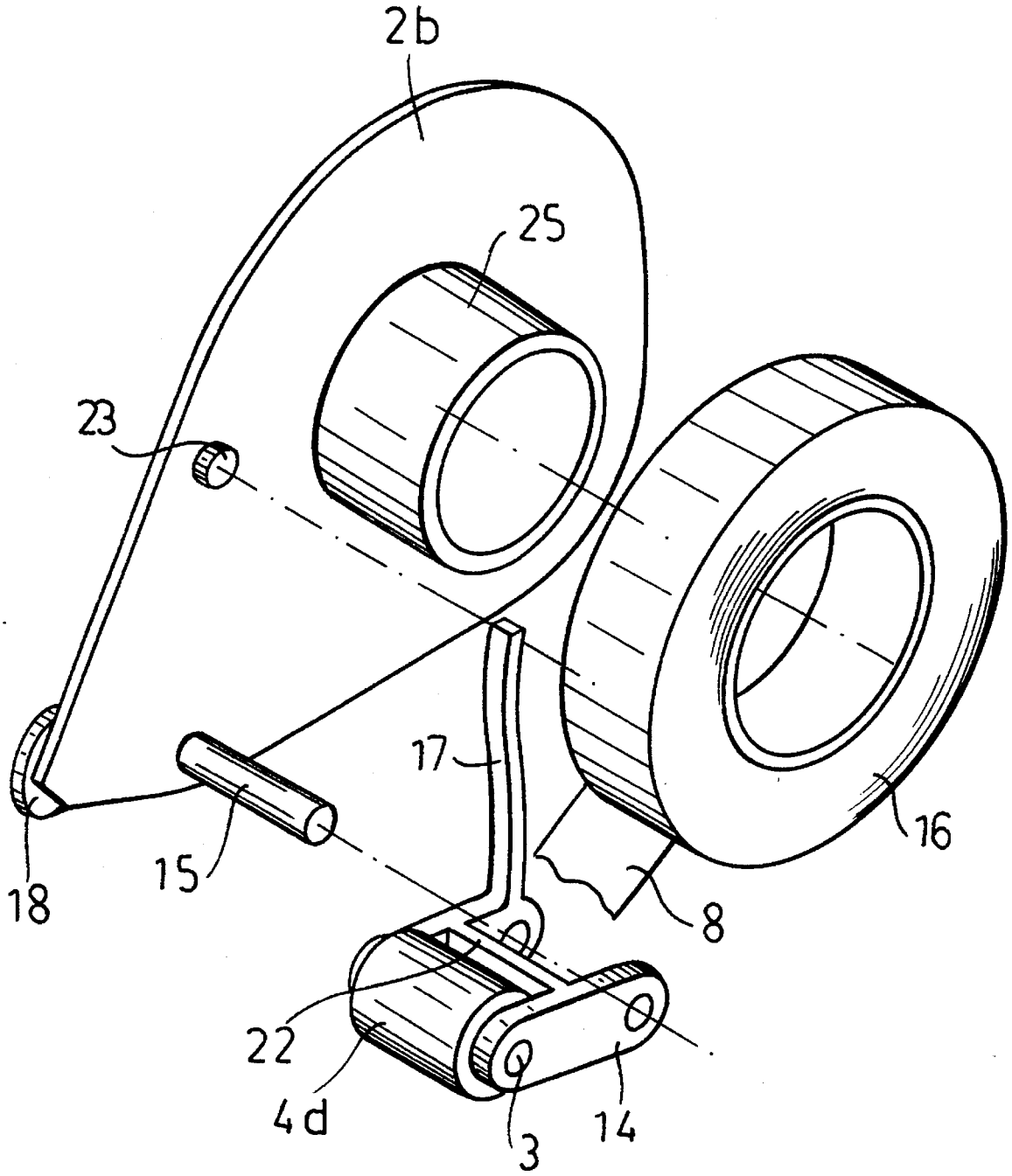
FIG. 6 is an exploded view of another dispenser according to the invention.

In the system of FIG. 6 a housing plate 2*b* is formed with a pivot pin 15 on which are mounted arms 14 whose free ends carry the pivot 3 of the roller 4*d*. This roller 4*d* is made along its full axial length of the same material that is of the same compressibility along its full length and that is of continuous cylindrical shape. An elastically deformable spring extension 17 of the arms 14 is braced against a stop pin 23 on the housing plate 2*b*, which is also formed with a mount 25 for the tape supply 16, to resiliently resist rotation of the arms 14 so that the roller 4*d* moves back up into the housing. In addition the end of the housing carries rollers 18 (only one shown) having outer surfaces that are of the same diameter as the roller 4*d* and that are coaxial therewith in the normal unstressed position of this roller 4*d*.

Thus in this arrangement the roller 4*d* is depressed upward into the device when same is pressed down against the substrate. Once, however, the skids or rollers 18 come into contact with the substrate, the roller 4*d* stops moving inward, so that it is pressed against the substrate with a force determined exclusively by the force of the spring arm 17, so long of course as the roller 18 is pressed down with a greater force. As in the above-described embodiments where the construction of the roller limits the force it can apply to the tape 8, here the spring arm 17 defines this upper force limit.

We claim:

1. In combination with a tape having a sticky side, a dispenser comprising:

a housing adapted to hold a supply of the tape;

a roller rotatable on the housing about an axis and having a mainly cylindrical outer surface projecting radially past the housing and having a relatively soft central portion;

guide means for passing the tape partially around the roller with its sticky side turned radially away from the roller and with the tape engaging radially inwardly against the soft central portion of the roller surface, whereby the tape can be pressed by the roller against a substrate to adhere the tape to the substrate and to inwardly deflect at least the soft central portion of the roller surface; and means including a pair of relatively hard end flanges formed on the roller and axially aligned with and flanking the soft central portion of the roller surface out of contact with the tape for permitting deflection of the soft central portion of the roller surface in contact with the tape radially inward until the end flanges operatively engage the substrate and for preventing further radial inward deflection of the soft central portion of the roller surface even if the end flanges are pressed with greater force against the substrate.

2. The tape dispenser defined in claim 1 wherein the end flanges are axially extended and form the guide means.

3. The tape dispenser defined in claim 1 wherein the flanges are unitarily formed with the roller surface.

4. The tape dispenser defined in claim 1 wherein the roller has a central elastomeric covering that is relatively thick in the soft central portion and has thin end regions that extend axially over the flanges.

5. The tape dispenser defined in claim 1 wherein the roller has between the flanges an elastomeric covering.

6. The tape dispenser defined in claim 5 wherein the flanges project radially between 0.05 mm and 0.1 mm past the covering.

7. The tape dispenser defined in claim 5 wherein the covering is formed as an elastomeric tube.

8. The tape dispenser defined in claim 5 wherein the covering has a Shore A hardness between 15 and 40.

9. The tape dispenser defined in claim 1 wherein the flanges are of slightly greater diameter than the roller.

10. The tape dispenser defined in claim 1 wherein the roller surface is formed of an elastically compressible material.

11. The tape dispenser defined in claim 10 wherein the material has a Shore A hardness of between 20 and 50.

12. The tape dispenser defined in claim wherein the end flanges are formed of a metal or a hard synthetic resin.

13. In combination with a tape having a sticky side, a dispenser comprising:

a housing adapted to hold a supply of the tape;

a roller rotatable on the housing about an axis and having an outer surface projecting radially past the housing and constituted by a substantially cylindrical and relatively soft central portion relatively compressible radially inward, and a pair of relatively hard and radially incompressible end flanges axially flanking the soft central portion for permitting deflection of the soft central portion of the roller surface in contact with the tape radially inward until the end flanges operatively engage the substrate and for preventing further radial inward deflection of the soft central portion of the roller surface even if the end flanges are pressed with greater force against the substrate; and guide means for passing the tape partially around the roller with its sticky side turned radially away from the roller and with the tape engaging radially inwardly against the soft central portion of the roller surface while remaining out of contact with the end flanges.

* * * * *